United States Patent [19]

Jalil et al.

[11] 4,106,519

[45] Aug. 15, 1978

[54] VANE-TYPE NOZZLE ASSEMBLY

[75] Inventors: Asjed A. Jalil, Holden; C. Allen Rich, Southboro, both of Mass.

[73] Assignee: Morgan Construction Company, Worcester, Mass.

[21] Appl. No.: 750,760

[22] Filed: Dec. 15, 1976

Related U.S. Application Data

[63] Continuation of Ser. No. 497,030, Aug. 13, 1974, abandoned, which is a continuation of Ser. No. 353,496, Apr. 23, 1973, abandoned.

[51] Int. Cl.[2] ..... B08B 3/02

[52] U.S. Cl. ..... 134/122 R; 134/199; 118/DIG. 18; 266/113

[58] Field of Search ..... 134/64 R, 64 P, 122 R, 134/122 P, 199; 239/553.5, 590.5; 266/111-113; 118/307, DIG. 18, DIG. 22, DIG. 11, DIG. 13

[56] References Cited

U.S. PATENT DOCUMENTS 2,542,237 2/1951 Dewey ..... 134/122

FOREIGN PATENT DOCUMENTS 496,231 11/1938 United Kingdom ..... 239/553.5

*Primary Examiner*—Robert L. Bleutge

*Attorney, Agent, or Firm*—Thompson, Birch, Gauthier & Samuels

[57] ABSTRACT

An apparatus for applying a liquid, for example cooling water, to the surface of an axially moving elongated element, for example a hot rolled rod in a rolling mill. The apparatus includes a housing having an interior chamber through which extends a guide assembly. The guide assembly in turn defines a longitudinally extending passageway which is suitably adapted and dimensioned to accommodate movement therethrough of the elongated element. Liquid is admitted into the chamber through an inlet in the housing and is thereafter fed into the passageway through an orifice in the guide assembly. Vanes in the chamber prevent the liquid entering the orifice from swirling about the longitudinal axis of the passageway.

1 Claim, 5 Drawing Figures

VANE-TYPE NOZZLE ASSEMBLY

This is a continuation of application Ser. No. 497,030 filed Aug. 13, 1974, which in turn is a continuation of application Ser. No. 353,496 filed Apr. 23, 1973 both now abandoned.

DESCRIPTION OF THE INVENTION

This invention relates to an improved apparatus for applying a liquid to the surface of an axially moving elongated element. The invention is particularly useful in, although not limited to rod and bar rolling mills where cooling water is applied to the surface of the stock immediately following the rolling operation.

Rod and bar products are cooled from their finishing temperatures down to equalized temperatures of 1300° F to 1700° F in water cooled delivery pipes. The cooling is performed by applying water to the surface of the product by various means, such as for example water nozzles or flooded cooling pipes. Stripper nozzles that apply water in an opposite or "counter-current" direction to product travel are also used in order to confine the water to a specific wetted length or region essential for controlled cooling.

In the past, it has been observed that the stock vibrates considerably in the water delivery pipes and this unstable condition in turn leads to poor stripping as well as cobble occurrences. It has now been determined that the problem of rod vibration is caused by the manner in which the cooling water exits from the cooling nozzles. More particularly, in the past, the cooling water has developed a considerable swirling action, and it is this action which has caused the product to vibrate violently.

It is, accordingly, an object of the present invention to provide an improved apparatus or nozzle for applying a liquid such as cooling water to an axially moving elongated element or product length which nozzle eliminates or at least substantially minimizes liquid swirl and the product vibration produced thereby. To this end, the nozzle includes a housing having an interior chamber through which extends a guide assembly made up of replaceable inserts. The guide assembly defines a longitudinally extending passageway which is suitably adapted and dimensioned to accommodate movement therethrough of the product. The adjacent ends of the replaceable inserts which make up the guide assembly are spaced to define an orifice which surrounds the longitudinal axis of the passageway. Cooling water is fed into the housing chamber and then passes through the orifice into the passageway for application to the surface of the product moving therethrough. The orifice may be arranged to direct a cone-shaped spray in the same direction as that of the direction of travel of the product, in which event the nozzle will be "co-current", or in the alternative, the orifice may be arranged to direct the cone-shaped spray in a direction opposite to that of the direction of product travel, in which event the nozzle will be "counter-current". In both the counter-current and co-current nozzles, radially arranged vanes in the chamber prevent the liquid entering the orifice from swirling about the axis of the passageway, and this in turn substantially minimizes product vibration. The stripping action of counter-current nozzles is thus enhanced considerably, and in both counter-current and co-current nozzles, cobble occurrences are reduced markedly.

These and other objects and advantages of the present invention will become more apparent as the description proceeds with the aid of the accompanying drawings wherein.

Figure 1:
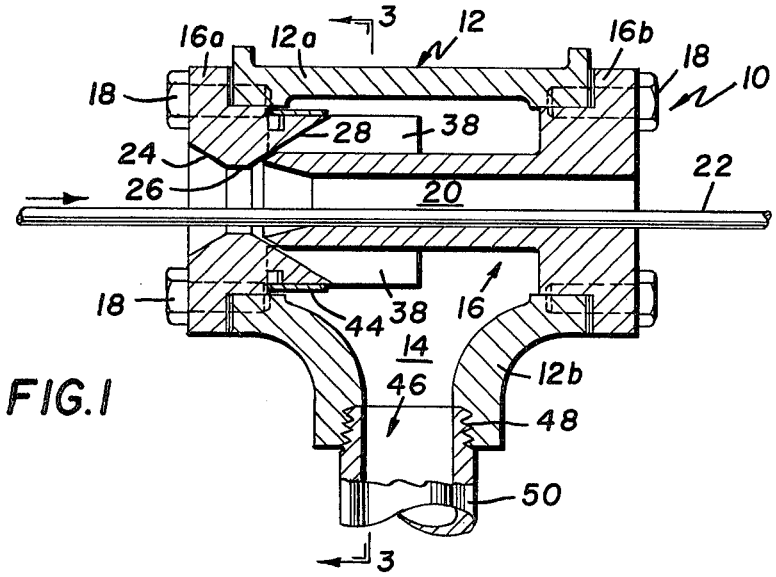
FIG. 1 is a view in cross-section of one embodiment of a nozzle embodying the concepts of the present invention, specifically a counter-current stripping nozzle of the type employed to apply cooling water to an axially moving product length in a rolling mill.

Referring now to the drawings, and with initial reference to FIGS. 1 and 2 to 5, there is generally indicated at 10 a counter-current stripping nozzle embodying the concepts of the present invention. The nozzle includes a generally T-shaped housing 12 which is made up of a first tubular section **12*a* and a second laterally extending tubular section 12*b*. The housing defines an interior chamber 14 through which extends a guide assembly generally indicated at 16. The guide assembly is made up of axially aligned replaceable inserts 16*a* and 16*b*, each being affixed to opposite ends of the tubular housing section 12*a* by any convenient means, such as for example heavy machine screws 18. The inserts 16*a* and 16*b* cooperate to define a passageway 20 which is suitably adapted and dimensioned to accommodate movement therethrough of an axially moving elongated element or product length 22**.

The interior wall of the insert **16*a* is provided with a converging section 24, an intermediate section 26 and a diverging section 28. The converging section 24 forms an entry mouth for the product 22 entering the passageway 20. The diverging section 28 cooperates with a spaced oppositely inclined surface 30 on the adjacent end of the other insert 16*b* to form an orifice 32 which surrounds the path traveled by the product 22, and which leads inwardly from the chamber 14 to the passageway 20**.

The inner end of the insert **16*a* is further provided with a plurality of radial slots 34 and a circular groove 36. A plurality of flat vane members 38 are seated in the slots 34. Each vane member has a laterally protruding ear 40 which engages the inside wall 42 of the groove 36. A vane retaining ring 44 surrounds the slotted end of the insert 16*a* and retains the vanes 38 in their respective slots 34**.

The lower end of the tubular housing section **12*b* forms an inlet 46 which may be conveniently threaded as at 48 for connection to a feed pipe 50. In operation, liquid such as for example cooling water is fed into the chamber 14 through the inlet 46. From here the water is fed through the orifice 32 into the passageway 20 for application to the surface of the product 22. As the water approaches the orifice 32, it passes between the radially arranged vanes 38. The vanes direct the water into the orifice 32 and prevent the water from swirling about the longitudinal axis of the passageway 20. By preventing this swirling action, product vibration in the passageway 20 is substantially minimized, with the result that the stripping action of the nozzle 10** is considerably improved while at the same time avoiding any tendency of the product to cobble.

Figure 2:
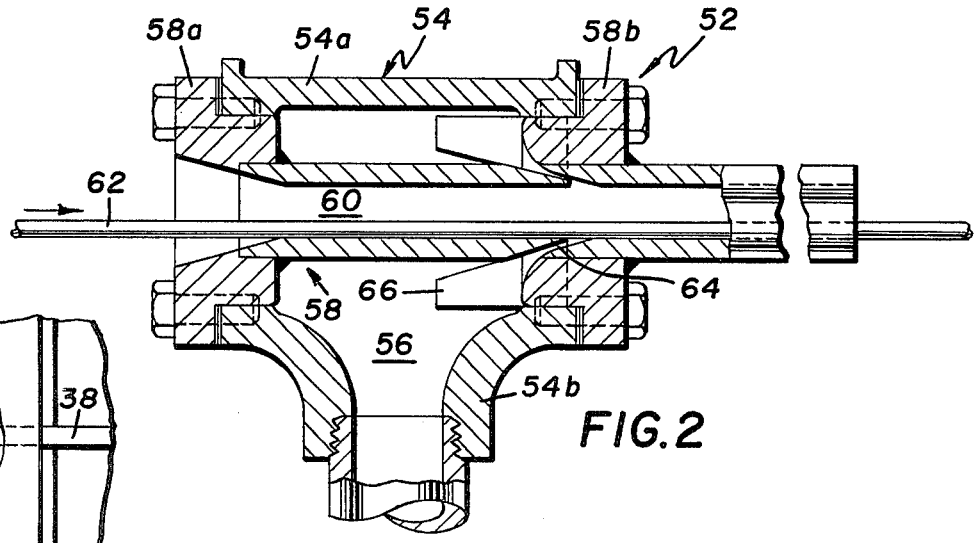
FIG. 2 is a cross-sectional view of an alternate embodiment of the invention, specifically a co-current nozzle.
Figure 5:
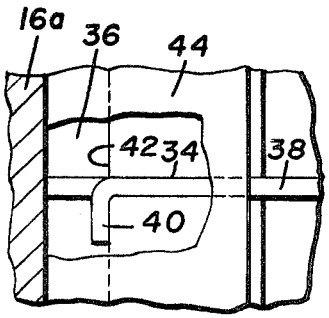
Figure 3:
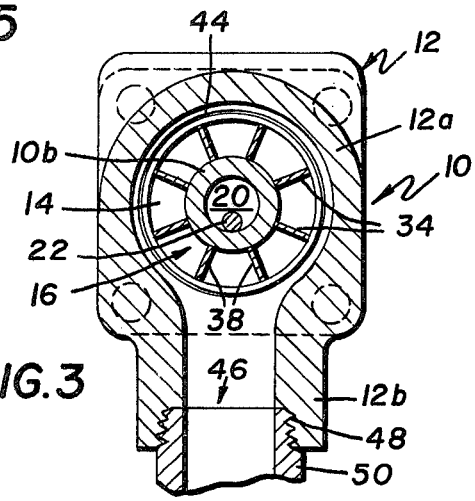
FIG. 3 is a sectional view taken along lines 3—3 of FIG. 1.
Figure 4:
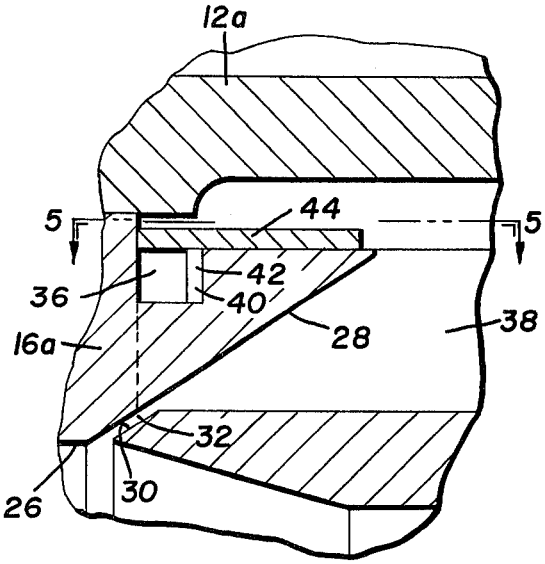
FIG. 4 is an enlarged view of a portion of the nozzle shown in FIG. 1; and, FIG. 5 is a partial view taken along lines 5—5 of FIG. 4, with a portion of the vane retaining ring broken away.

FIG. 2 illustrates a co-current nozzle 52 embodying the concepts of the present invention. As with the nozzle 10 shown in FIGS. 1 and 3–5, this nozzle also includes a T-shaped housing 54 made up of a first tubular section 54*a* and a second tubular section 54*b* extending laterally therefrom. The housing 54 defines an interior chamber 56 through which extends a guide assembly 58 made up of mating replaceable inserts 58*a* and 58*b*. The inserts cooperate to define a passageway 60 which is suitably dimensioned and adapted to accommodate movement therethrough of a product length 62, and a circular orifice 64 leading from the chamber 56 into the passageway 60. The orifice 64 is arranged to direct liquid in a cone-shaped spray which converges in the same direction as that of the product 62 moving axially through the passageway 60. The inside end of insert 58*b* is again provided with a plurality of radial slots having seated therein vane members 66. The vane members protrude into the orifice 64 and are radially held between the insert member 58*a* and the tubular section 54*a* of the housing 54.

The vane members 66 in this nozzle serve the same function as the vane members 38 in nozzle 10, namely, to direct the liquid passing through orifice 64 in a manner which avoids swirling and hence eliminates or at least substantially minimizes product vibration.

In light of the foregoing, it will now be apparent to those skilled in the art that changes and modifications may be made to the embodiments herein chosen for purposes of disclosure without departing from the spirit and scope of the invention. For example, as can be seen by a comparison of the vanes 38 and 66, changes in vane design can be made in order to accommodate different nozzle designs. The cross-sectional configuration and/or size of the orifices, and the design and arrangement of the replaceable inserts, may also be changed. It is our intention to cover these and any other changes or variations encompassed by the following claims.

We claim:

1. Apparatus for applying a liquid to the surface of an axially moving elongated element, said apparatus comprising: a housing including first and second communicating tubular sections arranged in a generally T-shaped configuration, said first tubular section defining an interior chamber; guide means for defining a passageway extending longitudinally through said chamber, said guide means including mating elements protruding into said chamber from opposite ends of said first tubular section, said passageway being suitably dimensioned and adapted to accommodate movement therethrough of an elongated element; inlet means in said second tubular section for admitting liquid into said chamber; the adjacent ends of said mating elements being spaced to define an orifice which surrounds said passageway and through which liquid flows from said chamber into said passageway for application to the surface of the elongated element moving axially therethrough, one of said mating element being provided at a location adjacent to said orifice with a plurality of slots arranged radially in relation to the longitudinal axis of said passageway; and vane means for directing the flow of liquid into said orifice, said vane means comprising flat plate members seated in said slots and protruding therefrom at said orifice into said chamber.

* * * * *